US005297853A

United States Patent [19]

Sollami

[11] Patent Number: 5,297,853

[45] Date of Patent: Mar. 29, 1994

[54] INSERT FOR RADIAL CUTTER

[75] Inventor: Phillip A. Sollami, Herrin, Ill.

[73] Assignee: The Sollami Company, Herrin, Ill.

[21] Appl. No.: 38,327

[22] Filed: Mar. 29, 1993

[51] Int. Cl.[5] ..... E21C 27/44; E21C 35/18

[52] U.S. Cl. ..... 299/79; 175/427

[58] Field of Search ..... 299/79, 91, 34; 175/427, 428

[56] References Cited

FOREIGN PATENT DOCUMENTS

| | | | |
|---|---|---|---|
| 538396 | 10/1933 | Fed. Rep. of Germany | 299/79 |
| 3427353 | 2/1986 | Fed. Rep. of Germany | 299/79 |
| 1534067 | 7/1968 | France | 299/79 |
| 529937 | 12/1940 | United Kingdom | 299/79 |
| 919905 | 2/1963 | United Kingdom | 299/79 |

*Primary Examiner*—David J. Bagnell

*Attorney, Agent, or Firm*—Patnaude, Videbeck & Marsh

[57] ABSTRACT

An insert in accordance with the present invention is attachable to a seat on a mining machine such as a continuous mining machine or a radial longwall. The insert has a cutting face, an inner end, an outer end, and a back adapted to be retained on a seat for retaining an insert. The back of the insert has a protrusion thereon, which may be in the shape of a longitudinal rib, and positioned adjacent each side of the longitudinal rib, a flat. The rib may have any desired cross section, but in the preferred embodiment the rib has an arcuate cross section, or V-shaped cross section. Also a stub on the inner end of the insert fits into a bore in the seat to position the insert during braising.

10 Claims, 4 Drawing Sheets

INSERT FOR RADIAL CUTTER

The present invention relates to an insert for attachment to a radial cutter such as used in mining machines, and in particular to an insert having a protrusion along the back side thereof and a stub at one end thereof for positioning the insert on a supporting body.

BACKGROUND OF THE INVENTION

Mining machines, such as longwall mining machines and continuous mining machines have a rotating cutter with a plurality of carbide inserts at the outer ends of the cutter which strike against the wall of the mine to loosen stone and coal for later removal. In the course of operating such equipment, the carbide inserts gradually wear away. Furthermore, the carbide inserts are braised into seats on supporting body members and on some occasions, the braising which retains the insert to the seat fractures, and the entire insert is lost. When a mining machine loses or breaks one or more of the carbide inserts, the machine will commence operating unevenly, will vibrate, and will cause stress to other portions of the machine, such that the machine must be shut down and repaired.

The carbide inserts of such machines are braised to removable bit bodies and, therefore, the removable body for which the carbide insert has been broken must be removed and replaced by a new or remanufactured body after which the machine can be placed back in service. To minimize the cost of maintenance of such machines, the bit bodies having damaged carbide inserts are remanufactured, during which the broken pieces of the prior carbide insert are removed, and a new carbide insert is attached.

In the course of the use of a bit body, the cutting end of the carbide insert will become worn. Worn carbide inserts can be reground without removing the insert from the body to which it is attached, but the grinding process also results in the grinding away of a portion of the body behind the distal end of the carbide. As a result, remanufactured bodies frequently do not provide support behind the entire length of the insert, and fracturing of the carbide insert is more common in remanufactured bodies.

Furthermore, prior art carbide inserts are braised to the seat of a body by visually positioning the carbide insert on the seat of the body and clamping the carbide insert in the desired location. The carbide insert is then braised to the seat of the body, after which the clamp is removed. The visual positioning of the carbide insert upon the seat of a body results in some misalignment of the insert upon the body. Where an insert has not been properly positioned and braised to a body, it will be subjected to uneven forces and the entire carbide insert may break away from the body. Approximately seven percent of the failure of all carbide inserts occurs as a result of breakage of the braising caused by the misalignment of the carbide insert.

It would, therefore, be desirable to provide a carbide insert for a mining machine which would be self centered upon the body during the braising process. Furthermore, it would be desirable to provide a carbide insert which is reinforced along its longitudinal length to reduce the failure of remanufactured bit bodies.

SUMMARY OF THE INVENTION

Briefly, an insert in accordance with the present invention is attachable to a seat on a mining machine such as a continuous mining machine or a radial longwall. The insert has a cutting face, an inner end, an outer end, and a back adapted to be retained on a seat for retaining an insert.

In the preferred embodiment, the back of the insert has a protrusion thereon, which may be in the shape of a longitudinal rib, and positioned adjacent each side of the longitudinal rib, a flat. The rib may have any desired cross section, but in the preferred embodiment the rib has an arcuate cross section, or V-shaped cross section.

Another feature of the present invention is a stub positioned on the inner end of the insert. In the preferred embodiment, the stub is cylindrical in shape and extends axially outward from the inner end of the insert.

A mining machine adapted to receive an insert in accordance with the present invention has a seat having a bottom surface and an inner surface. The bottom surface of the seat has a longitudinal groove which is complementary to the shape of the back of the insert and is adapted to receive the back of the insert. The inner surface of the seat has a bore which is sized and positioned so as to receive the stub of the insert to retain the insert upon the seat while the insert is braised to the seat. When the protrusion of the insert is fitted into the groove of the seat and the stub is fitted into the bore on the inner face of the seat, the insert will be retained in an aligned position for braising.

GENERAL DESCRIPTION OF THE DRAWINGS

A better and more complete understanding of the present invention may be had by a reading of the following description taken in connection with the accompanying drawings wherein.

DETAILED DESCRIPTION OF THE PREFERRED EMBODIMENT

Figure 4:
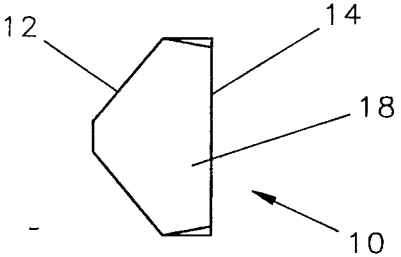
FIG. 4 PRIOR ART
FIG. 4 is an end view of a prior art insert.
Figure 3:
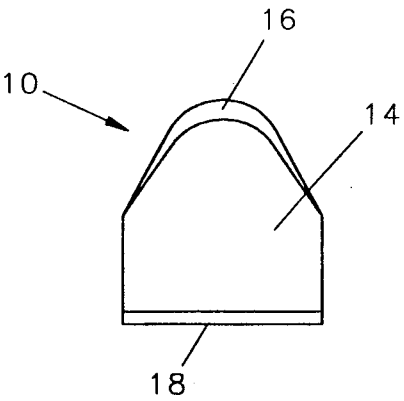
FIG. 3 PRIOR ART
FIG. 3 is a bottom view of a prior art insert.
Figure 2:
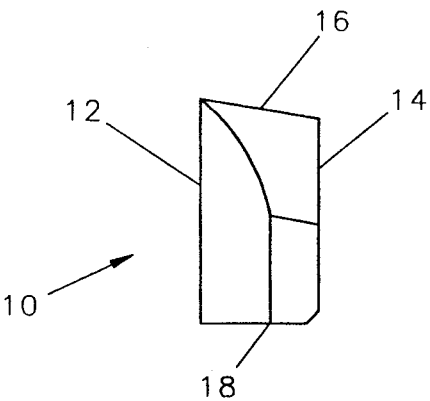
FIG. 2 PRIOR ART
FIG. 2 is a side view of a prior art insert.
Figure 1:
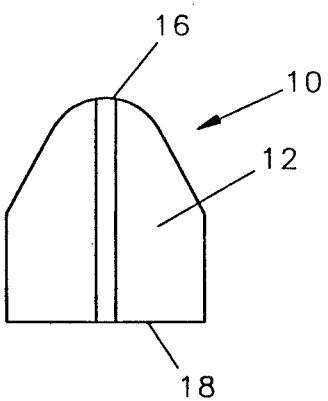
FIG. 1 PRIOR ART
FIG. 1 is a top view of a prior art insert.

Referring to FIGS. 1, 2, 3 and 4, an insert 10, which is typically made of carbide and configured in accordance with the prior art is shown. The insert 10 has an upper, cutting face 12 which is generally V-shaped, a back 14, an outer end 16 and an inner end 18. When an insert 10 in accordance with the prior art is attached to a seat on a mounting body for use in a radial cutter, it is manually set into the seat and clamped into position. The insert contacts the seat of the body along the back 14 and the inner end 18 and these surfaces are thereafter braised to complementary surfaces on the seat.

Figure 8:
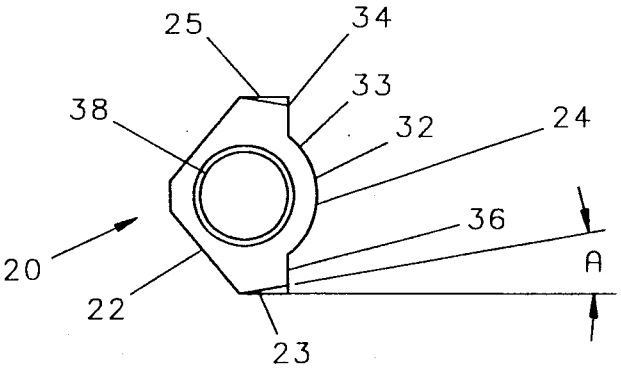
FIG. 8 is a view of the inner end of the insert shown in FIG. 5.
Figure 7:
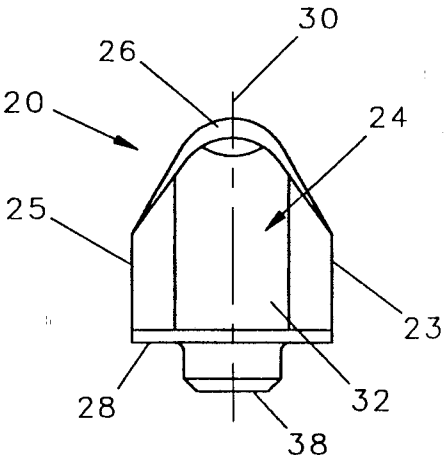
FIG. 7 is a bottom view of the insert shown in FIG. 5.
Figure 6:
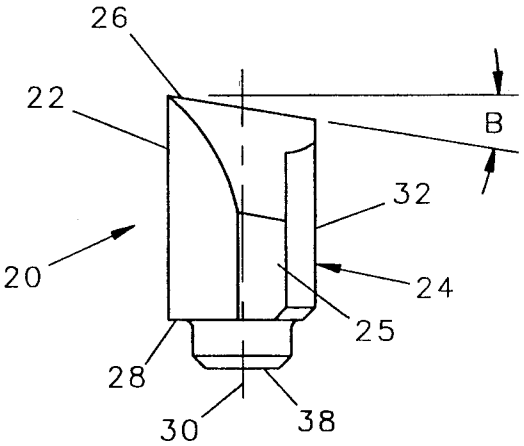
FIG. 6 is a side view of the insert shown in FIG. 5.
Figure 5:
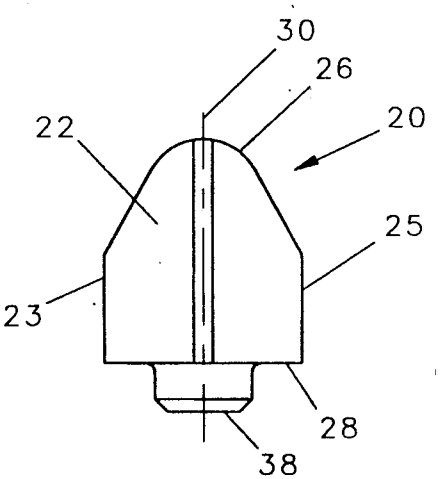
FIG. 5 is a top view of an insert in accordance with the present invention.

Referring to FIG. 5, 6, 7 and 8 in which an insert 20 in accordance with the present invention is shown which has an upper cutting face 22 which is also V-shaped and is similar to that of the prior art. The insert 20 also has a back 24 which is adapted to be positioned against the bottom of a seat, nearly parallel opposing planar sides 23, 25, a rounded outer end 26, and an inner end 28 adapted to be positioned against an inner surface of a seat to which the insert is braised. The nearly parallel opposing planar sides 23, 25 have a nominal inward relief angle A of about 7 degrees as shown in FIG. 8 to avoid binding of the sides 23, 25 during cutting. As a result, the perimeter of the outer end 26 is narrower adjacent the back 24 than it is adjacent the cutting face 22. Similarly, the outer end 26 has a relief angle B of about 12 degrees as shown in FIG. 6 and the portion of the outer end 26 adjacent the back 24 does not extend outward as far as the portion adjacent the cutting face 22. The insert 20 also has a centrally located longitudinal axis 30.

As in the prior art, the cutting face 22 and the outer end 26 of the insert 20 are adapted to strike against the walls of a mine to remove stone or coal from the outer surface thereof. The outer end 26 of the insert 20 has a generally curved shape similar to that of the prior art.

The back 24 of the insert 20 has a longitudinal protrusion 32 which in the preferred embodiment is a rib extending parallel to the longitudinal axis 30 of the insert 20. As can be seen in FIG. 8, the protrusion 32 has an arcuate outer surface 33 and adjacent each side of the longitudinal protrusion 32 is a pair of longitudinally extending co-planar flats 34, 36, the surfaces of which are parallel to the longitudinal axis 30. Finally, extending axially from the inner end 24 of the insert 20 and substantially perpendicular to the inner end 24, is a generally cylindrical stub 38.

Figure 9:
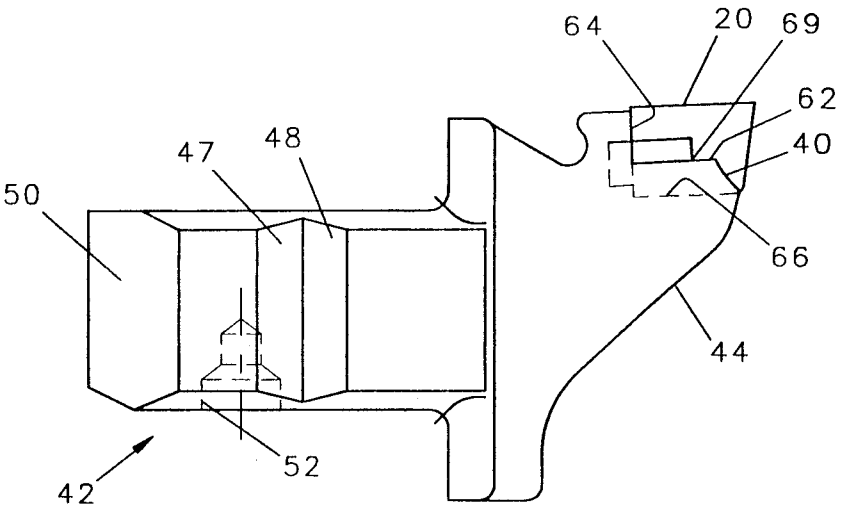
FIG. 9 is a reduced side view of a body with the insert shown in FIG. 5 attached thereto with portions of the insert shown in phantom lines.
Figure 10:
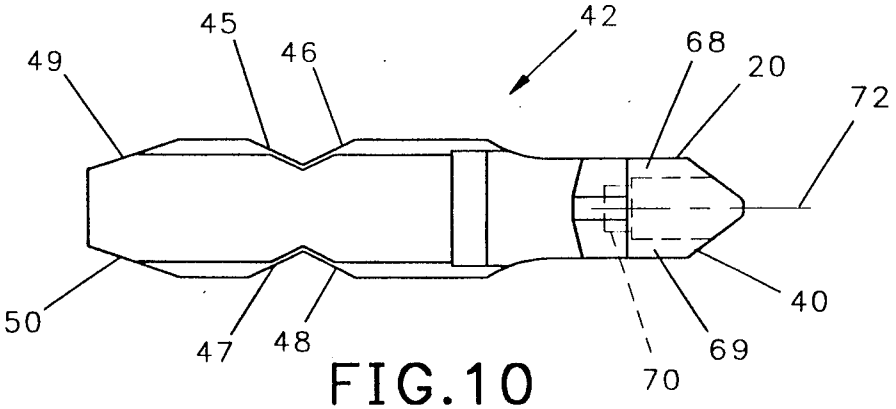
FIG. 10 is a reduced top view of a body with the insert shown in FIG. 5 attached thereto, with portions of the insert shown in phantom lines.
Figure 11:
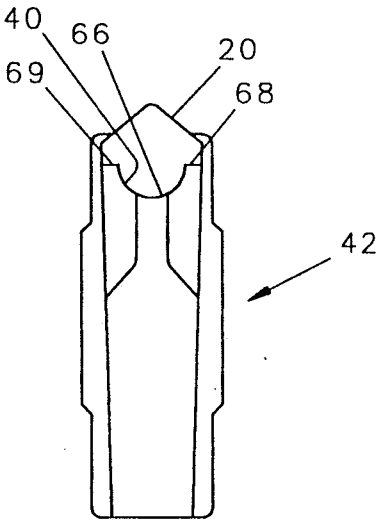
FIG. 11 is a reduced end view of a body with the insert shown in FIG. 5 attached thereto.

Referring to FIGS. 9, 10 and 11 , the insert 20 is adapted to fit on a seat 40 of a body 42 which is attachable to the cutter of a mining machine or the like. The body 42 has a seat 40 suitable for retaining an insert 20, but otherwise, the shape of the body may be different for attachment to different types of machines, or different for attachment to similar machines but made by different manufacturers. The body 42 depicted herein is typical of such bodies and includes a support 44 below the seat 40 through which force is transferred from a machine to an insert 20 which in turn is forced against the wall of a mine. The body 42 also has a number of forged surfaces such as shown at 45, 46, 47, 48, 49, 50 which will mate with complimentarily shaped surfaces on the machine to thereby position the body 42 and the insert 20 thereon. The body also has a bore 52 for receiving a plastic retaining plug, not shown, for retaining the body to the machine. The features as described above may be configured differently in order to attach to the bodies of different machines as previously stated, however, similar features are common to all bodies to which inserts 20 according to the present invention are attached.

At the outer end of the body 42, is the seat 40 which has a lower surface 62 and substantially perpendicular to the lower surface 62, an inner face 64. The lower surface 62 has a centrally located longitudinal groove or recess 66 and on either side of the recess 66 a pair of planar surfaces 68, 69. A cylindrical blind bore 70 extends into the inner face 64 and has an axis 72 which is substantially parallel to the planar surfaces 68, 69 and is substantially perpendicular to the inner face 64. The bore 70 extends into the inner face 64 the seat 40 a distance which is a little deeper than the length of the stub 38. The longitudinal recess 66 and the adjacent planar surfaces 68, 69 are sized so as to be complementary to the longitudinal protrusion 32 and adjacent flats 34, 36 of the insert 20. Similarly, the cylindrical bore 70 has a diameter slightly larger than the outer diameter of the cylindrical stub 38 of the insert 20. The cylindrical bore 70 is positioned in the inner face 64 such that when the cylindrical stub 38 of the insert 20 is positioned therein, the longitudinal protrusion 32 will be adjacent the longitudinal recess 66 and the flats 34, 36 will be adjacent the planar surfaces 68, 69. When the insert is so positioned on the seat, and the distances separating the parts of the seat 40 from the parts of the insert 20 will be a distance of approximately 0.003 inch to 0.010 inch, which is the spacing which is most suitable for braising the insert 20 to the seat 40.

To attach an insert 20 in accordance with the present invention to a body 42, braising flux is placed on the seat 40, and the back 24 and inner end 28 of the insert 20. A disc of braising material is fitted into the open end of the bore 70, and the longitudinal protrusion 32 is fitted into the recess 66, and the stub 38 is fitted into the bore 70 such that the surfaces of the insert 20 are spaced from the surfaces of the seat a distance suitable for braising as described above. Thereafter, the distal end of the body 42, including the insert 20 are subjected to heat which is sufficient to liquefy the braising material and the liquid material will move by capillary action between adjacent surfaces of the insert 20 and the seat 40.

When an insert 20 in accordance with the present invention is fitted onto a seat 40 and braised thereto as described above, the insert 20 will be self centered over the seat 40 of the body 42 and the centering will be more accurate and more uniform than has been possible to achieve with prior art inserts. As a result, machines provided with inserts in accordance with the present inventions will not be misaligned on the seat and will not fail along the braise.

When a body 42 is remanufactured, a recess 66 is machined in the lower surface 62 thereof and a bore 70 is drilled in the inner face 64 thereof. As previously stated, such remanufactured bodies 42 may have portions of the support 44 steel ground away as a result of prior efforts to resharpen an insert which has since been removed from the body. In this case, the outer end 26 of the insert 20 may extend beyond the distal end of the support 44. The longitudinal protrusion 32 of the insert 20 therefore provides additional support within the insert such that it is less susceptible to breakage, which is especially important when it is fitted on a remanufactured body.

When an insert 20 is fitted on a seat 40 as described above, the flats 34, 36 of the insert 20 will be adjacent the planar surfaces 68, 69 of the seat 42, and will resist rotation of the insert which may otherwise occur as a result of uneven forces applied during the operation of the machine.

Figure 13:
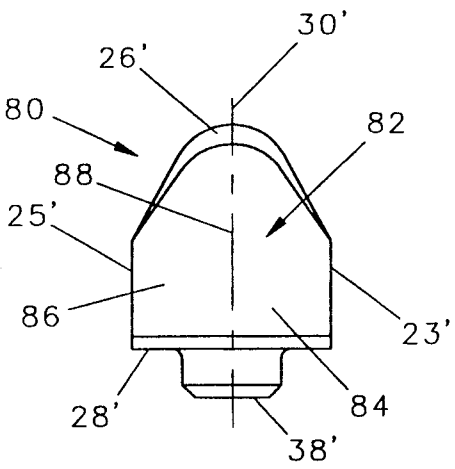
FIG. 13 is a bottom view of the insert shown in FIG. 12.
Figure 14:
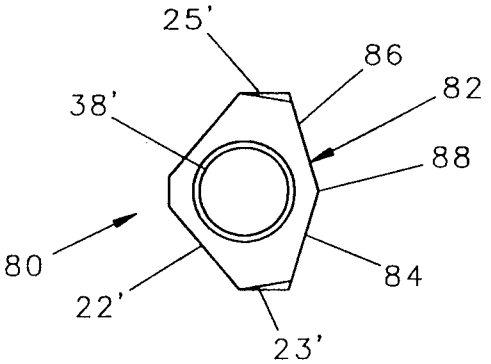
FIG. 14 is an end elevational view of the inner end of the insert shown in FIG. 12.
Figure 12:
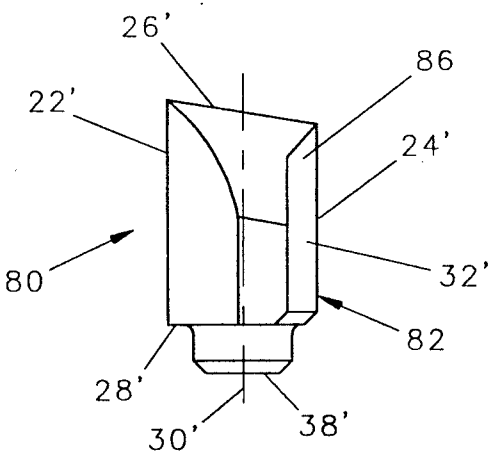
FIG. 12 is a side elevational view of a second embodiment of an insert in accordance with the present invention.

Referring to FIGS. 12, 13, and 14, an alternate embodiment of an insert 80 is shown in which the parts thereof which are like those shown in the first embodiment bear like indicia numbers except that they are primed. In this embodiment, the back 24' of the insert 80 has a V-shaped protrusion 82 having planar surfaces 84, 86 which intersect each other along a longitudinal ridge 88 extending parallel to the longitudinal axis 30' thereof.

An insert 80, in accordance with the alternate embodiment is attachable to a body, not shown, which has a seat adapted to receive the V-shaped back 24'. As with the first embodiment, when the longitudinal protrusion 32' is fitted within the cylindrical bore in the body, the angular surfaces 84, 86 of the insert 80 will be positioned 0.003 inch to 0.010 inch from the complementary surfaces of the seat, so as to be suitable for braising. The planar surfaces 84, 86 will also resist rotation of the insert within the seat.

There is, therefore, disclosed an insert which will be self centered upon a body so as not to be subject to failure as a result of inaccurate centering prior to braising. Furthermore, the insert 20, 80 in accordance with the present invention, will have a thicker central section and thereby provide greater longitudinal strength to the insert and will resist rotation of the insert within the seat to which it is attached.

While the present invention has been described in connection with two embodiments thereof, it will be appreciated by those skilled in the art that many changes and modifications can be made without departing from the true spirit and scope of the invention. Therefore, it is intended by the appended claims to cover all such changes and modifications which come within the true spirit and scope of the invention.

What is claimed is:

1. An insert for attachment to a seat of a radial cutter having a recess in the bottom of said seat, and said seat having an inner face with a centrally located hole therein, said insert comprising in combination:

a cutting face, a back adapted to be retained on said seat, an inner end complimentary to said inner face of said seat, and an outer end, said back having a protrusion thereon adapted to fit within said recess on said seat, and said inner end having a cylindrical stub extending therefrom, said stub having a diameter less than the outer dimensions of said inner end, and said inner end having a planar portion surrounding said stub.

2. An insert in accordance with claim 1 wherein said protrusion is a longitudinal rib extending from said inner end to said outer end.

3. An insert in accordance with claim 2 further comprising a pair of longitudinal flats, one of said flats positioned adjacent each side of said rib.

4. An insert in accordance with claim 2 wherein said rib has a V-shaped cross-section.

5. An insert in accordance with claim 2 wherein said rib has a arcuate cross-section.

6. The combination comprising:

a body for attachment to a radial cutter, the body having means for attaching said body to a radial cutter, and a seat, said seat including a lower surface and an inner face, said lower surface having a recess therein, and said inner face having a hole therein, an insert on said seat, said insert having a cutting face, a back with a longitudinal protrusion, said back fitted against said lower surface and said longitudinal protrusion fitted into said recess, and said insert having an inner end with a stub extending therefrom, said inner end of said insert fitted against said inner face of said seat, and said stub fitted in said hole.

7. The combination in accordance with claim 6 wherein said protrusion has an arcuate cross section.

8. The combination of claim 7 wherein said insert has a pair of flats having planes parallel with a longitudinal axis of said insert, and each of said flats is fitted against a planar surface on said seat.

9. The combination of claim 6 wherein said protrusion has a V-shaped cross section.

10. The combination of claim 6 wherein said inner end has a planar portion surrounding a base of said stub, and said stub has a diameter less than any outer dimension of said inner end.

* * * * *